US007086580B2

(12) United States Patent
Liou

(10) Patent No.: US 7,086,580 B2
(45) Date of Patent: Aug. 8, 2006

(54) PAPER CONTAINER

(76) Inventor: Wen-Chen Liou, No. 16, Alley 1, Lane 36, Sec. 1, Shenlin Rd., Taya Hsiang, Taichung Hsien (TW)

( * ) Notice: Subject to any disclaimer, the term of this patent is extended or adjusted under 35 U.S.C. 154(b) by 103 days.

(21) Appl. No.: 10/806,286

(22) Filed: Mar. 23, 2004

(65) Prior Publication Data

US 2005/0211758 A1 Sep. 29, 2005

(51) Int. Cl.
*B65D 3/14* (2006.01)

(52) U.S. Cl. ..... 229/407; 220/574; 220/612; 220/633; 220/635

(58) Field of Classification Search ..... 229/4.5, 229/5.5, 5.8, 406, 407; 220/574, 612, 628, 220/633, 635
See application file for complete search history.

(56) References Cited

U.S. PATENT DOCUMENTS

| | | | | | |
|---|---|---|---|---|---|
| 1,771,765 | A * | 7/1930 | Benson | 229/4.5 |
| 1,904,331 | A * | 4/1933 | Sidebotham | 229/5.5 |
| 1,946,611 | A * | 2/1934 | Carew | 229/5.5 |
| 1,968,270 | A * | 7/1934 | Thiebaut | 229/5.5 |
| 2,032,815 | A * | 3/1936 | Shuey | 229/5.5 |
| 2,074,325 | A * | 3/1937 | Carew | 229/5.5 |
| 2,114,395 | A * | 4/1938 | Logan | 229/4.5 |
| 2,126,159 | A * | 8/1938 | Wilcox | 229/5.5 |
| 2,166,265 | A * | 7/1939 | Ressinger | 229/5.5 |
| 2,297,842 | A * | 10/1942 | Roach | 229/4.5 |
| 2,331,901 | A * | 10/1943 | Norwood | 229/5.5 |
| 2,398,404 | A * | 4/1946 | Brooks | 229/5.5 |
| 3,357,625 | A * | 12/1967 | Malmgren | 229/407 |
| 5,062,568 | A * | 11/1991 | Hill et al. | 229/4.5 |
| 6,364,201 | B1 * | 4/2002 | Varano | 229/4.5 |
| 2003/0183681 | A1 * | 10/2003 | Liou | 229/400 |

* cited by examiner

*Primary Examiner*—Gary E. Elkins
(74) *Attorney, Agent, or Firm*—Rosenberg, Klein & Lee

(57) ABSTRACT

A paper container includes a base disk and a peripheral wall having a ledge extending from a bottom edge of the peripheral wall to engage with a bottom face of the base disk, a side wall integrally formed adjacent to the ledge and having an inner surface to engage with a peripheral edge of the base disk, a knurl formed between the ledge and the side wall for engagement with a surface and a lip ring formed on a top edge of the peripheral wall such that an annular space is formed between the base disk and the peripheral wall.

3 Claims, 6 Drawing Sheets

PAPER CONTAINER

BACKGROUND OF THE INVENTION

1. Field of the Invention

The present invention relates to a paper container, and more particularly to a container made of paper and having a central disk-like sheet and an annular sectorial side face attached to a peripheral edge of the central sheet.

2. Description of Related Art

A conventional paper container (40), as shown in FIGS. 6 and 7, is formed on a paper sheet (30) which has multiple concentric circles. Therefore, by proper pressing, multiple paper containers (40) are formed. Furthermore, patterns (41) are formed on side walls of the paper container (40) to increase the paper container strength to resist deformation.

However, after a paper container (40) of this kind is formed, forming the patterns (41) on the side walls of the paper container (40) increases the manufacture and labor cost. Besides, because the paper container is made from a single paper sheet (30), the base ring, which later on is held by a user, has poor heat isolation such that the user can not hold the paper container if the paper container is filled with a hot content.

To overcome the shortcomings, the present invention tends to provide an improved paper container to mitigate the aforementioned problems.

SUMMARY OF THE INVENTION

The primary objective of the present invention is to provide an improved paper container composed of a base disk and an annular peripheral wall with a ledge extending out from a base ring which has a knurl formed on a joint between the ledge and the side wall to be engaged with a surface, such that the user is able to hold the paper container by the knurl and a lip ring formed on a free edge of the peripheral side wall.

Another objective of the present invention is that before the paper container is formed, the peripheral wall has a cutout defined in a portion of the peripheral wall so that when two distal ends of the peripheral wall are connected to one another, a conical shape is formed for connection with the base disk.

Other objects, advantages and novel features of the invention will become more apparent from the following detailed description when taken in conjunction with the accompanying drawings.

DETAILED DESCRIPTION OF THE PREFERRED EMBODIMENT

Figure 1:
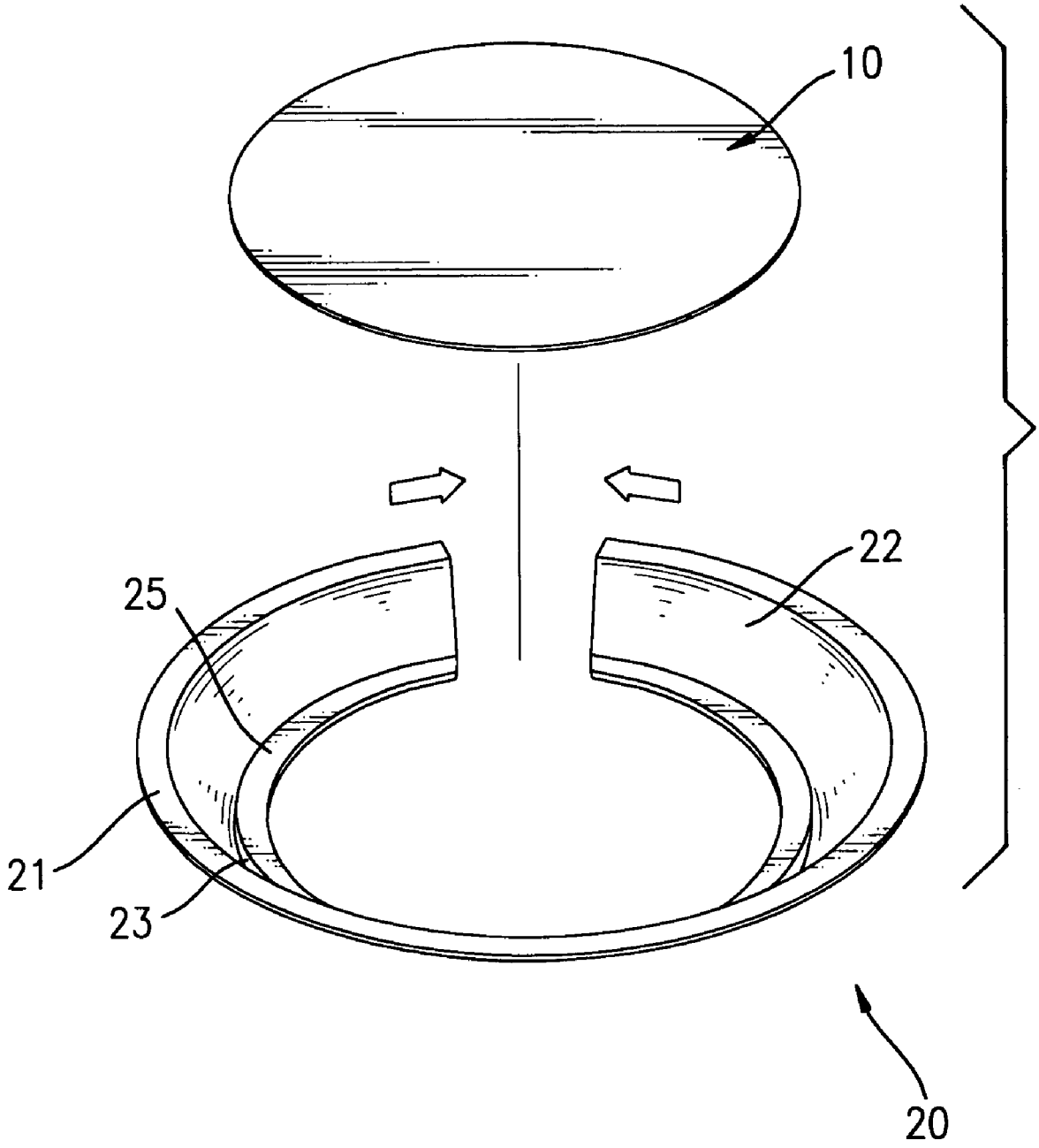
FIG. 1 is an exploded perspective view of the paper container of the present invention.

With reference to FIG. 1, a paper container in accordance with the present invention includes a base disk (10) and a peripheral wall (20).

The base disk (10) is a circular disk made of paper.

The peripheral wall (20) has a ledge (25) formed on a bottom edge of the peripheral wall (20) and extending in a first direction, a lip ring (21) formed on a top edge of the peripheral wall (20) and extending in a second direction opposite to the first direction of the ledge (25) and a knurl (23) formed on a joint between the ledge (25) and the side wall (22) of the peripheral wall (20). A cutout (A) is defined between two distal ends of the peripheral wall (20).

Figure 2:
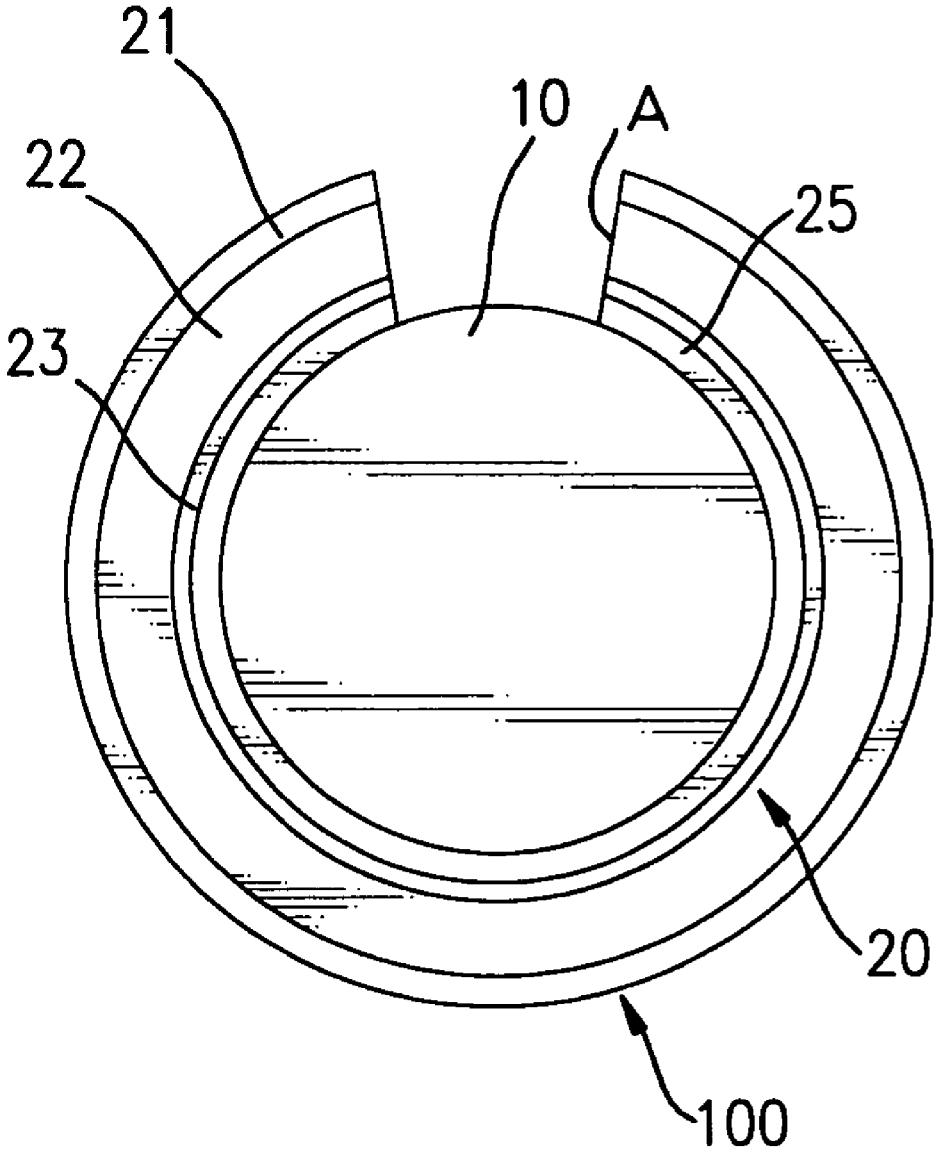
FIG. 2 is a top plan view of the semi-product of the paper container.
Figure 3:
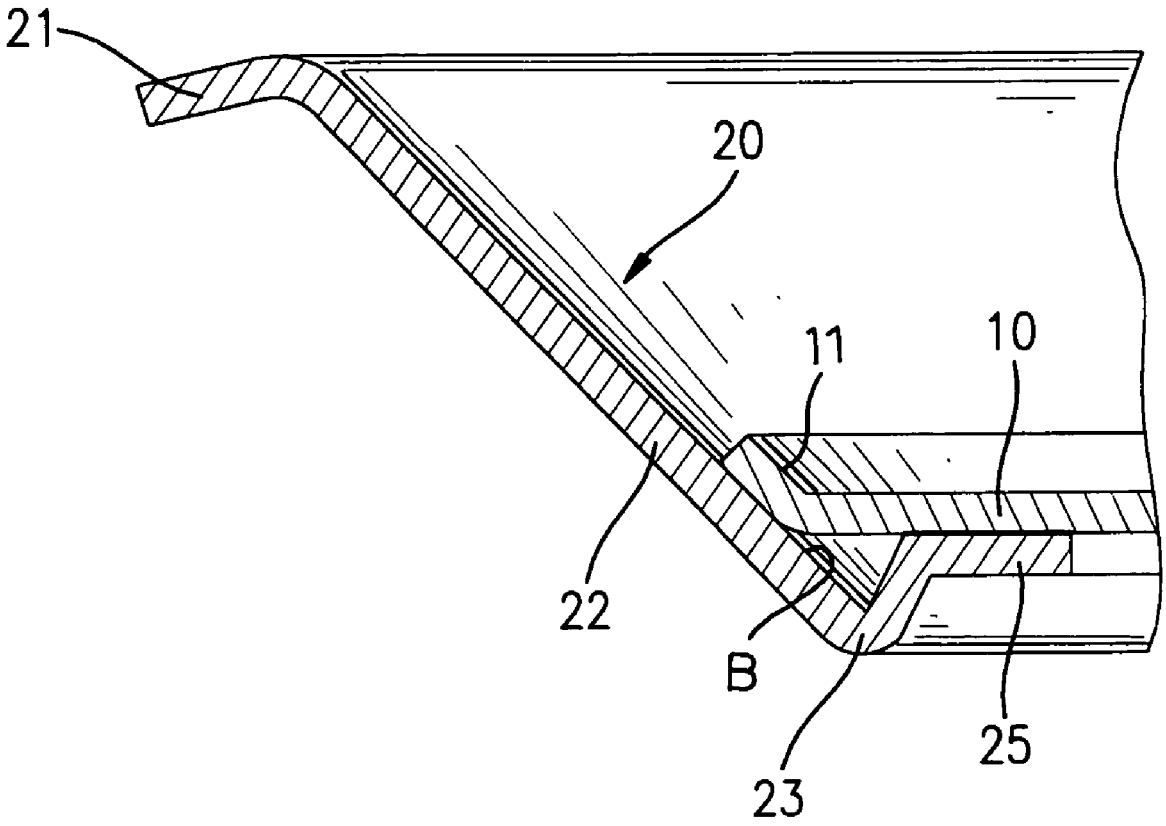
FIG. 3 is a schematic cross sectional view showing the engagement between the base disk and the peripheral wall.

With reference to FIGS. 2 and 3, when the base disk (10) and the peripheral wall (20) are combined, it is noted that the ledge (25) is securely engaged wit a bottom face of the base disk (10) which has a bend (11) formed on a peripheral edge of the base disk (10) to engage with an inner face of the side wall (22). After the engagement between the bend (11) and the inner face of the side wall (22), the combination between the base disk (10) and the peripheral wall (20) is accomplished. As a result of the provision of the knurl (23) extending out to engage wit a surface, an annular space (B) is defined between the base disk (10) and the peripheral wall (20) and the user is able to hold the paper container of the present invention without being burned by the heat of the object received in the paper container. Besides, because the bottom of the paper container is composed of two paper layers, the heat isolation effect of the paper container of the present invention is good.

Figure 4:
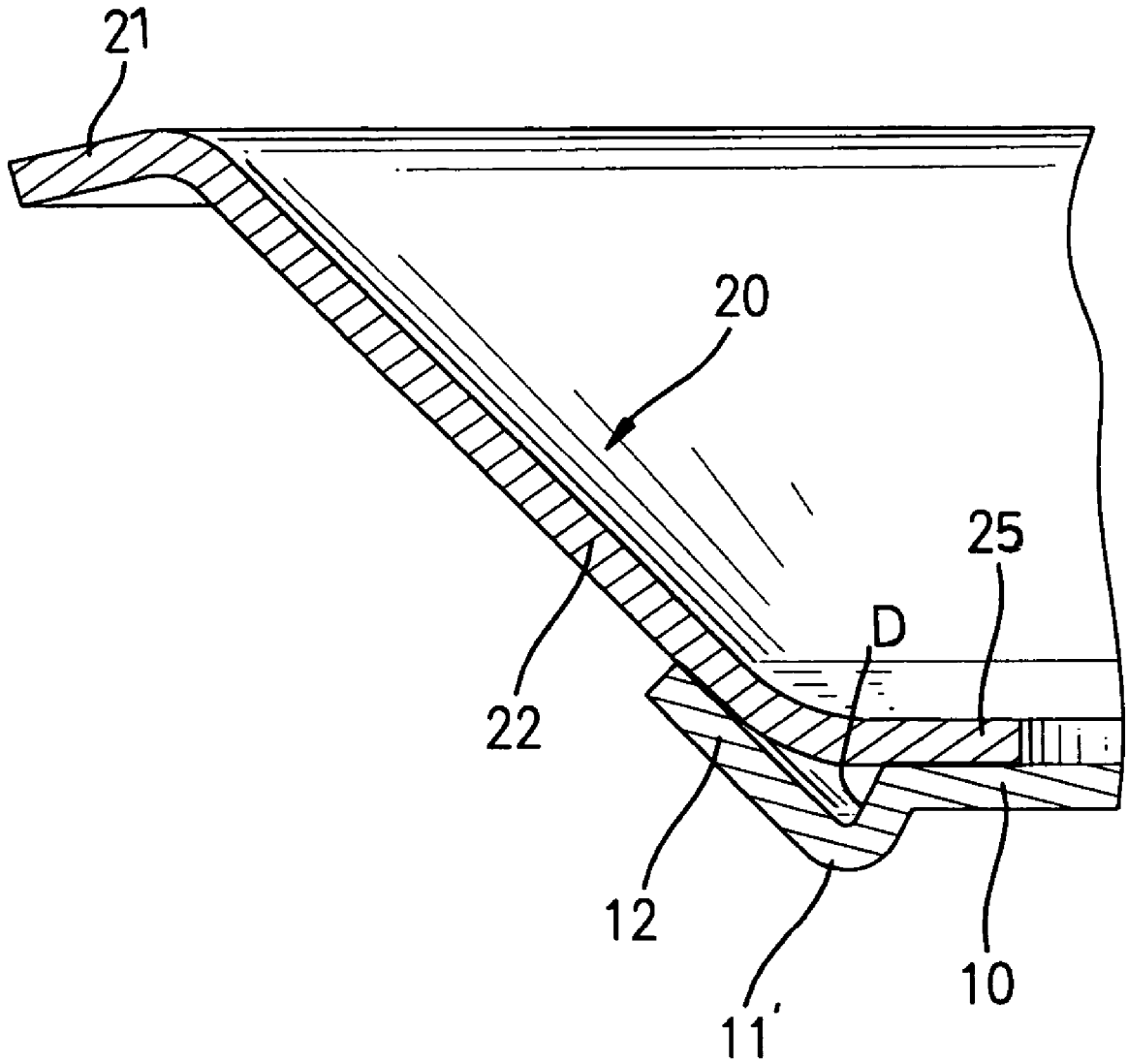
FIG. 4 is a schematic cross sectional view showing another preferred embodiment of the paper container of the present invention.

With reference to FIG. 4, another embodiment of the present invention is shown and the base disk (10) has a knurl (11') and a bend (12) formed on a peripheral edge of the base disk (10). The peripheral wall (20) has a ledge (25) formed on a bottom edge of the peripheral wall (20) and extending in a first direction and a lip ring (21) formed on a top edge of the peripheral wall (20) and extending in a second direction opposite to the first direction. When the base disk (10) and the peripheral wall (20) are combined, the ledge (25) is engaged with an inner face of the base disk (10) and an outer surface of the side wall (22) is engaged with an inner surface of the bend (12). Thus an annular space (D) is defined between the base disk (10) and the peripheral wall (20). Therefore, the user is able to hold the paper container of the present invention by the knurl (11') and the lip ring (21) without being burned by the heat of the object received in the paper container.

Figure 5:
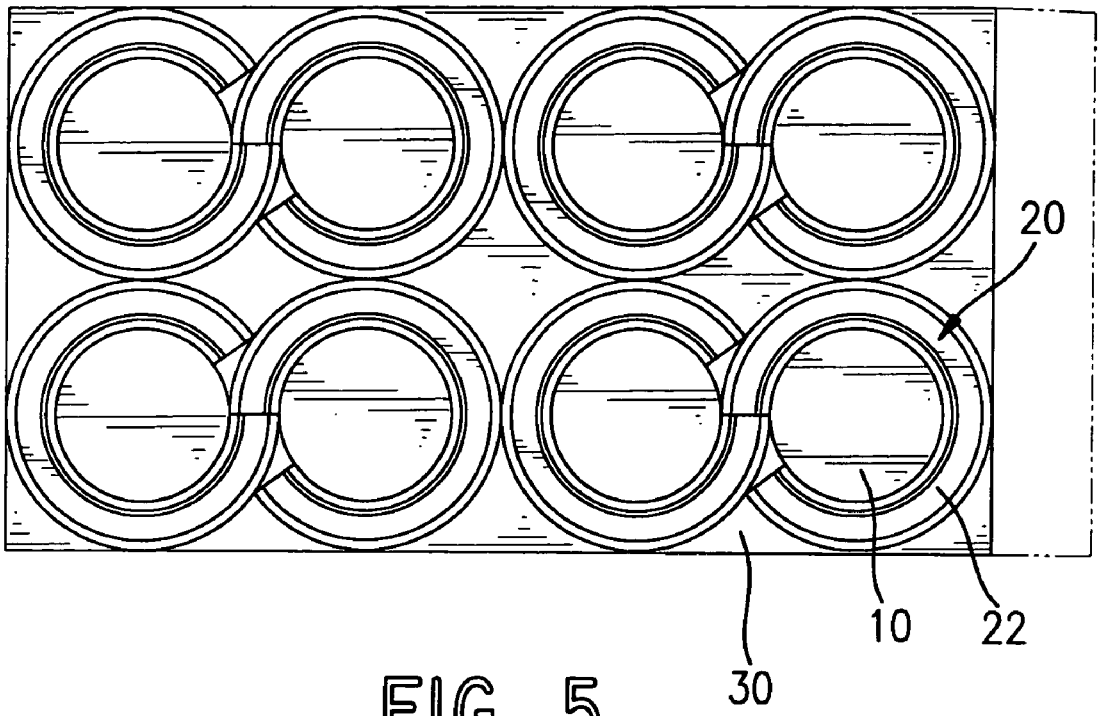
FIG. 5 is a top plan view showing that the paper container of the present invention is able to connect to another paper container easily to save space.
Figure 6:
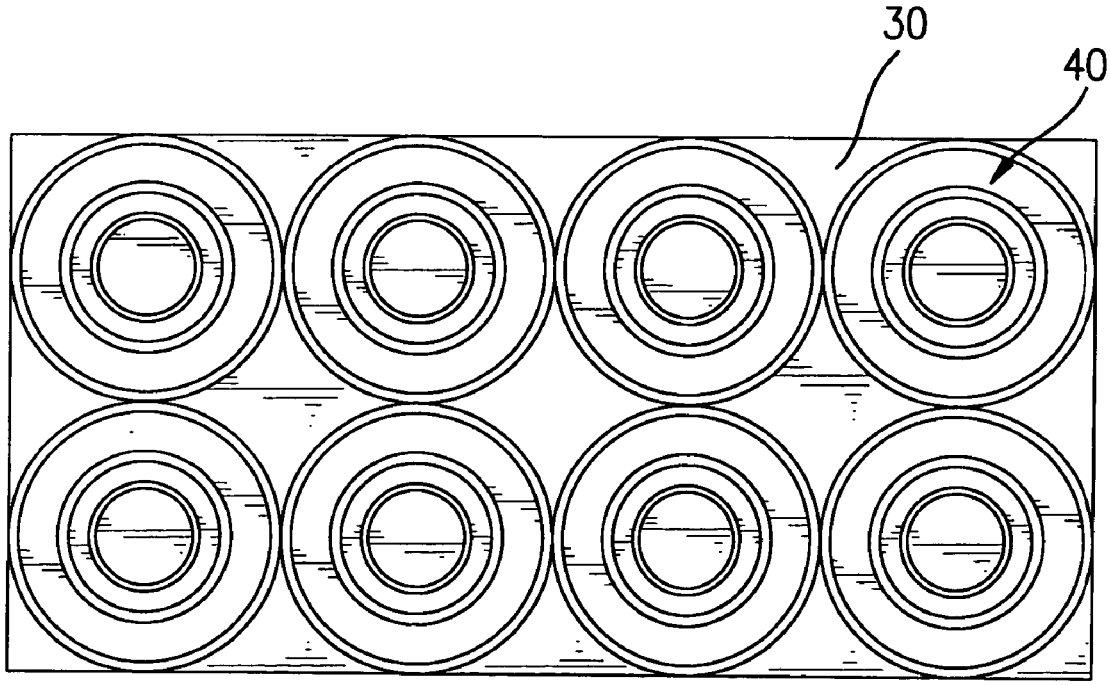
FIG. 6 PRIOR ART
FIG. 6 is a top plan view showing the formation of conventional paper containers.
Figure 7:
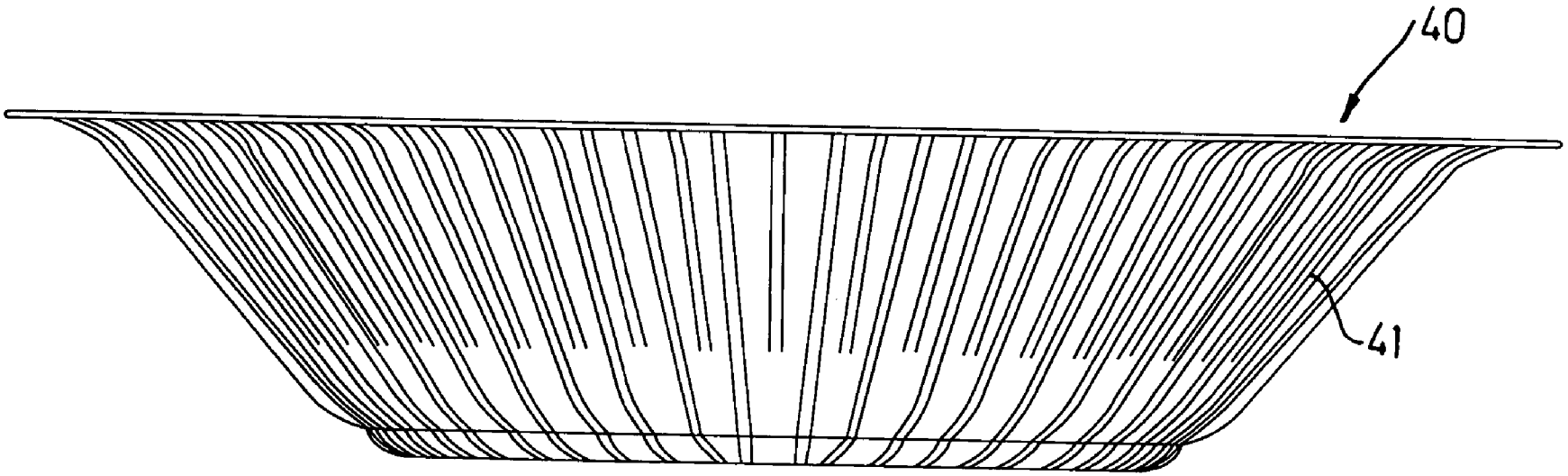
FIG. 7 PRIOR ART
FIG. 7 is a side plan view showing the shape of the conventional paper container.

With reference to FIG. 5, it is noted that when multiple paper containers of the present invention are stored or transported, due to the provision of the cutout (A) between two distal ends of the peripheral wall (20), two adjacent paper containers are easily cross-linked and thus space is saved.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A paper container comprising:

a base disk having an upwardly bent peripheral edge portion; and a peripheral wall having a ledge extending from a bottom edge of the peripheral wall and positioned to engage with a bottom face of the base disk, a side wall integrally formed with and adjacent to the ledge and having an inner surface to engage with the upwardly bent peripheral edge of the base disk above the position of the ledge, annular knurl formed between the ledge and the side wall and extending below the position of the ledge to form an annular space between a portion of the peripheral wall adjacent the knurl and the base disk for providing heat isolation thereto, and a lip ring formed on a top edge of the peripheral wall.

2. The paper container as claimed in claim 1, wherein the ledge extends in a first direction and the lip ring extends in a second direction opposite.

3. A paper container comprising:

a base disk having a central portion and an upwardly bent peripheral edge, the base disk having an annular knurl disposed adjacent the upwardly bent peripheral edge;

a peripheral wall having a ledge formed on a bottom edge of the peripheral wall, a side wall integrally formed with and adjacent to the ledge and a lip ring formed on a top edge of the peripheral wall, an inner face of the upwardly bent peripheral edge of the base disk being engaged with an outer surface of the side wall and the ledge being engaged with a corresponding portion of the central portion of the of the base disk, the knurl extending below the ledge and defining an annular space between a portion of the upwardly bent peripheral edge adjacent the knurl and the peripheral wall for providing heat isolation thereto.

* * * * *